US008478462B2

(12) United States Patent
Brady et al.

(10) Patent No.: US 8,478,462 B2
(45) Date of Patent: Jul. 2, 2013

(54) VEHICLE IDENTIFICATION TAG AND TRAIN CONTROL INTEGRATION

(75) Inventors: James Brady, Orange Park, FL (US); Harrison Thomas Hickenlooper, Palatka, FL (US)

(73) Assignee: Invensys Rail Corporation, Louisville, KY (US)

( * ) Notice: Subject to any disclaimer, the term of this patent is extended or adjusted under 35 U.S.C. 154(b) by 605 days.

(21) Appl. No.: 12/730,619

(22) Filed: Mar. 24, 2010

(65) Prior Publication Data

US 2011/0238241 A1 Sep. 29, 2011

(51) Int. Cl.
*G05D 1/00* (2006.01)
*G01C 21/00* (2006.01)

(52) U.S. Cl.
USPC ..... 701/19; 246/6 R

(58) Field of Classification Search
USPC ..... 701/19, 36; 246/1 C, 3, 6, 122 R, 246/123, 124, 182 R, 187 B
See application file for complete search history.

(56) References Cited

U.S. PATENT DOCUMENTS 6,081,769 A 6/2000 Curtis
6,511,023 B2 * 1/2003 Harland ..... 246/122 R
6,845,953 B2 1/2005 Kane et al.
6,865,454 B2 3/2005 Kane et al.
6,996,461 B2 2/2006 Kane et al.
2001/0022332 A1 * 9/2001 Harland ..... 246/122 R

OTHER PUBLICATIONS

"Encompass 1i Handheld AEI Reader Package," www.aeitag.com/en1ihaaeirep.html, 4 pages, visited Mar. 8, 2010.
"AEI Reference Architecture," www.railinc.com, 2007, pp. 1-23, Railing, A Subsidiary of the Association of American Railroads.

* cited by examiner

*Primary Examiner* — Richard M. Camby
(74) *Attorney, Agent, or Firm* — DLA Piper LLP US

(57) ABSTRACT

An identification tag reader reads identification tags on vehicles of a train consist. Identification tag identifiers are used to retrieve weights and lengths of the vehicles, and the weight and length information is used by an onboard train control system either to verify weight and length information already stored in the system or input the information initially, in either case for use in controlling the train such as in the calculation of braking curves. In another embodiment, an identification tag reader is paired with a sensor capable of detecting a condition on a train vehicle requiring maintenance, and the condition and an identification tag identifier are transmitted to maintenance personnel. The identification tag is preferably an AEI tag.

20 Claims, 3 Drawing Sheets

VEHICLE IDENTIFICATION TAG AND TRAIN CONTROL INTEGRATION

BACKGROUND

Automated train control systems are being utilized with increased frequency in the U.S. and in other countries around the world, both for freight and for passenger rail systems. In the U.S., recent legislation requires the installation of a positive train control (PTC) system on Class 1 freight rail lines and all tracks carrying passenger trains by 2016. Automated train control systems can come in many varieties. For example, the assignee of the present application currently offers a system sold under the TRAIN SENTINEL® mark as described in several U.S. patents, including U.S. Pat. Nos. 6,996,461, 6,865,454, and 6,845,953 (each of which is hereby incorporated herein by reference). Another PTC system is sold by WABTEC under the ETMS® mark. Systems such as these utilize vehicle borne computers that determine train position using global positioning system (GPS) receivers, wheel tachometers and other devices, and enforce movement authorities received from a central office by activating the train's brakes via a brake interface to prevent the movement authorities from being violated. Such systems often include onboard databases with locations of grade crossings, switches and other configurable devices and interrogate such devices to ensure correct configuration prior to the train's arrival. Still other PTC systems include the ITCS™ and ACSES™ systems, which utilize track mounted transponders or wayside beacons and transmit authorities, grade crossing and switch data from the wayside to computers on board the trains.

In PTC systems, having the correct train length is critical to ensuring that the end of a train has cleared a position such as a block boundary or a switch point. U.S. Pat. No. 6,081,769 uses GPS receivers in an end of train unit and at the head of train to determine train length. This technique is less than optimal because of position errors that are possible with GPS receivers and due to differences in train length that can result from slack between cars (which can be as much as one foot), which can be significant for freight trains that often exceed 100 cars in length. In the aforementioned TRAIN SENTINEL® system, the train operator enters the train length as given to him by the dispatcher on a pendant. This leads to a potential human error, both in the form of a miscommunication or improper entry of the information, or because the information is incorrect due to an error by classification yard personnel responsible for forming the train/consist.

Having the correct train weight is also important in a PTC system because the train weight, and sometimes the positions of the cars in the consist, are used in the calculation of the braking curve. There is a safety factor built into the braking curve, but it is still better to have the most accurate weight possible. If the train is lighter than the amount used by the PTC system for the braking curve calculations, the braking curve will force brake activation earlier than is necessary, causing less efficient operation. If the train is heavier than the amount used by the PTC system for the braking curve calculations, the safety margin is eroded and possibly exceeded, leading to a potentially unsafe condition.

AEI (automatic equipment identification) tags, which are a form of RFID tag, and AEM (automatic equipment maintenance) tags are currently used by railroads to track the movement of railroad cars and freight onboard those cars (hereinafter, AEI will be used to refer to both AEI and AEM tags). The American Association of Railroads ("AAR") has mandated the use of these tags, and it is estimated that in excess of 95% of the North American railroad car fleet has been outfitted with AEI tags. AEI tags are typically mounted on both sides of a railroad car approximately 40 inches above grade level and are read by special readers using radio frequency signals. Existing readers are typically located outside of the yard at various places along the wayside. There are believed to be more than 3,000 AEI readers installed in North America. To the knowledge of the inventors, the information from AEI tag readers has not been used for train control purposes such as to detect and/or correct errors in data used by the train and or in constructing consists.

DETAILED DESCRIPTION

In the following detailed description, a plurality of specific details, such as types of identification tags and PTC systems, are set forth in order to provide a thorough understanding of the preferred embodiments discussed below. The details discussed in connection with the preferred embodiments should not be understood to limit the present inventions. Furthermore, for ease of understanding, certain method steps are delineated as separate steps; however, these steps should not be construed as necessarily distinct nor order dependent in their performance.

Figure 2:
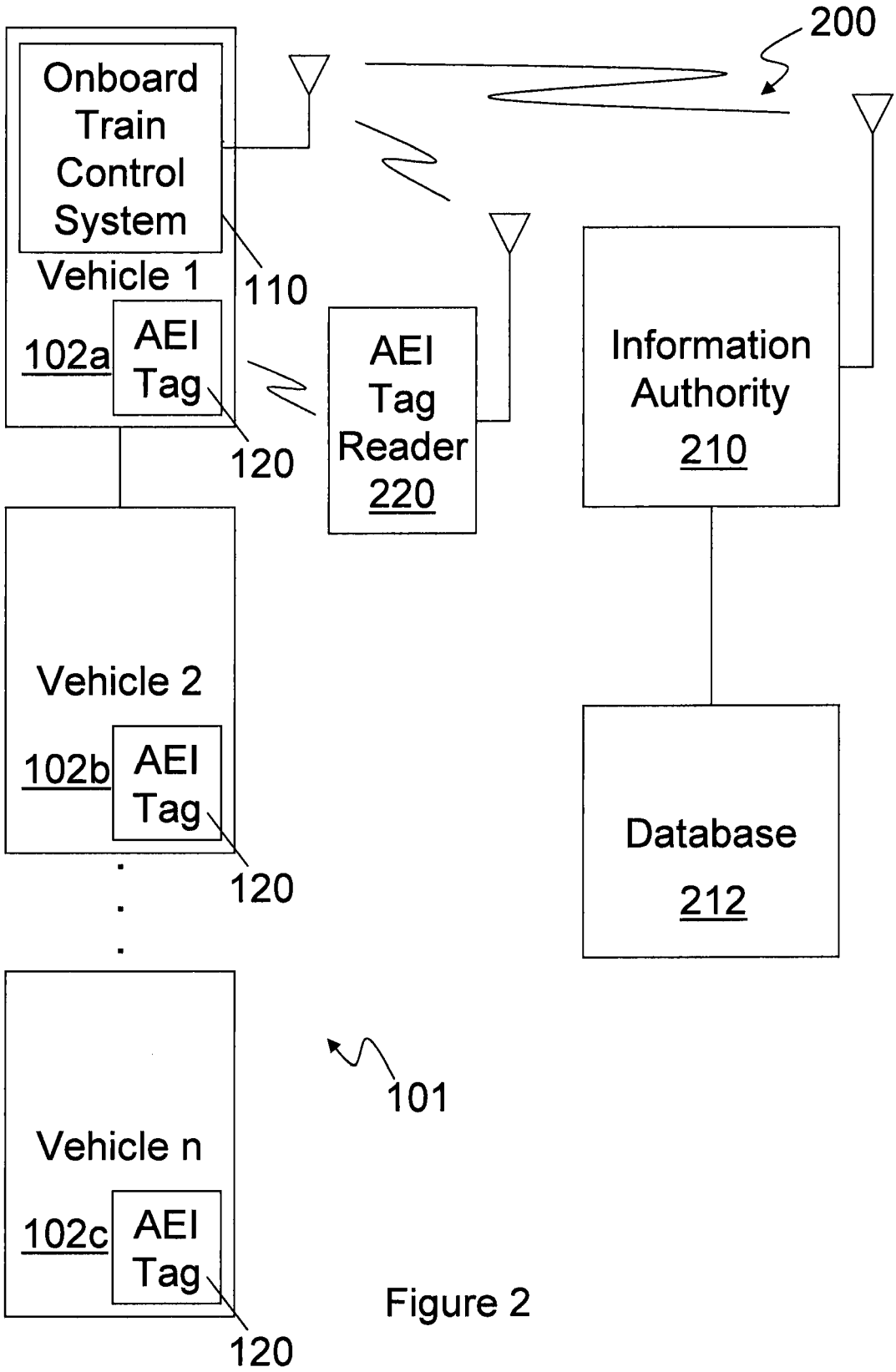
FIG. 2 is a block diagram of a train control system employing an AEI tag reader according to a second embodiment.

A train control system 100 is illustrated in FIG. 2. A train 101 includes multiple vehicles 102*a-n*, such as locomotives and freight cars as is typical on a freight train. The first vehicle 102*a* includes an onboard train control system 110. The onboard system 110 typically includes an onboard computer/controller, a high power radio transceiver for communication with devices located off of the train (e.g., a 220 MHz transceiver such as that anticipated for use in the PTC system currently being developed by the four U.S. Class 1 railroads), a GPS receiver, a brake system interface, a wheel tachometer interface, a track database, an end of train (EOT) unit (including low power 2 watt transceivers in the EOT unit and at the head of the train connected to the onboard controller/computer), and an operator interface as is described in the three patents discussed above. Each train vehicle also has at least one AEI tag 120 mounted thereon.

Figure 1:
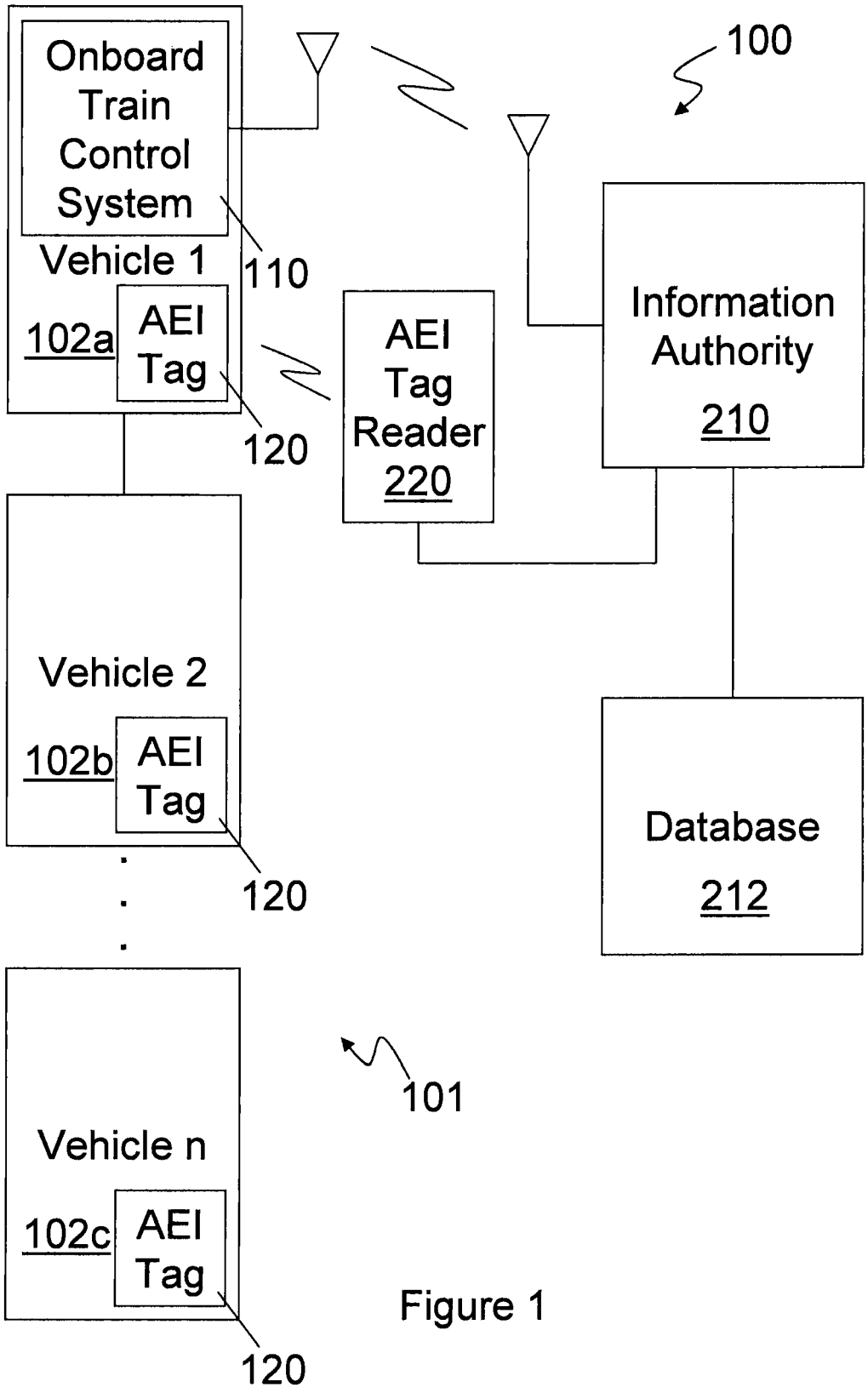
FIG. 1 is a block diagram of a train control system employing an AEI tag reader according to one embodiment.

An information authority 210 communicates with the onboard system 110. The information authority 210 can be located at a central office or any other location, and may form a part of a dispatching system or be a standalone system. The information authority 210 is in communication with an AEI tag reader 220. The AEI tag reader may be a stationary device permanently or temporarily mounted at a desired location that communicates with the information authority 210 over a wired connection, or may be a hand held device that communicates with the information authority 210 over a wireless connection. Although only one AEI tag reader is shown for ease of illustration, it should be understood that many such AEI tag readers may be in communication with the information authority 210. Further, although only one information authority is illustrated in FIG. 1, it should be understood that many (typically geographically distributed) such authorities may be present in some embodiments.

The information authority is connected to a database 212. The database 212 stores identifiers (e.g., identification numbers) associated with AEI tags on the train 101 and also stores corresponding weights and lengths of the vehicles associated with the AEI tags. As will be understood by those of skill in the art, the length of the vehicle is a fixed value but the weight of the vehicle can vary depending on cargo being carried by the vehicle. Accordingly, the database 212 may be interfaced to, or be a part of, a logistics system in some embodiments in order to obtain a current weight of the car. It should be understood that the database 212 may store information about many trains and cars in addition to those of the train 101.

The system 100 and its various components operate in a manner to ensure that the onboard train control system 110 has accurate information regarding the length and weight of all vehicles 102 in the train/consist 100. This may be accomplished in several ways.

In some embodiments, the operator of the train enters an expected train length and weight on an operator I/O device (e.g., a pendant) connected to the onboard train control system 110. This information may be provided to the operator from a dispatcher. Alternatively, the information authority 210 may provide this information directly to the onboard train control system 110. In yet other embodiments, no length or weight information is provided to the onboard train control system prior to reading of the AEI tags 120 by the AEI tag reader 220. Next, the AEI reader 220 reads the AEI tags 120 on each of the vehicles 102*a-n* of the train 101. This may be accomplished by, for example, a human being carrying a hand held AEI tag reader 220 while "walking the train" prior to movement of the train 101. Alternatively, the train 101 may be issued a limited authority to move in a yard so that it may move past a stationary AEI tag reader 220 located inside the yard. Those of skill in the art will recognize that the AEI tag reader 220 may be a simple device that reads tags and simply transmits the results, or in the case of a permanently installed stationary tag reader may be a more sophisticated device that is integrated with a wheel or axle sensor and equipped with software that detects the presence of a vehicle with missing or non-functional AEI tags in a consist.

When all of the AEI tags 120 have been read and transmitted from the AEI tag reader 220 to the information authority 210, the information authority 210 retrieves weight and length information corresponding to the identifiers read from the AEI tags 120 from the database 212. In embodiments in which initial length and weight information is received from the onboard train control system 110, this information is compared to the weight and length information retrieved from the database 212. In some embodiments, the onboard train control system 110 only utilizes a total length and weight. In such embodiments, the total weight and length of the individual vehicles retrieved from the database 212 is calculated and compared against the total train length and weight information from the onboard train control system 110. In other embodiments in which the onboard train control system 110 utilizes length and weight information for individual cars (and the order in which the cars are organized in the train), this information is compared to the information retrieved from the database 212. In either case, the information authority 210 informs the onboard train control system 110 that the information in use by that system is correct, or notifies that system of any discrepancy. In some embodiments, this notification may be relayed through a dispatcher or dispatching system. In such embodiments, the dispatcher may withhold movement authority to exit the yard and/or enter a main line track until the confirmation from the information authority 210 is received, and the confirmation of the correctness of the length and weight information to the onboard train control system 110 may take the form of receipt of the movement authority from the dispatcher rather than a direct communication from the information authority 210. In embodiments in which the onboard train control system 110 has no length or weight information prior to reading of the AEI tags 120 by the AEI tag reader 220, the length and weight information retrieved from the database 212 (again, this information may be a simple length and weight total for the train, or may be an ordered list of weights and lengths for each vehicle in the train/consist) is transmitted to the onboard train control system 110. The onboard train control system 110 preferably echoes the weight and length information or transmits an acknowledgement/confirmation message back to the entity (the information authority 210 or the dispatcher/dispatching system) from which it was received to ensure proper receipt of the information.

Those of skill in the art will recognize that the aforementioned process is straightforward when there are no discrepancies between the information retrieved on the basis of the AEI tags 120 and the expected train/consist information. The process is less straightforward when there is a discrepancy. While AEI tag readers are very accurate (some estimates place their accuracies above 99%), they are not foolproof. Similarly, errors in forming a consist are also possible. In the event that the AEI tag reader 220 detects one or more additional vehicles 102 in the train/consist 101, the length and weight of the additional vehicles 102 is added to the information for the train/consist 101 in use by the onboard train control system 110.

In the event that the AEI tag reader 220 does not detect one or more vehicles 102 in the expected consist information, there are several possibilities. In some embodiments, it is assumed that the AEI tag reader 220 information is incorrect due to either an error by the AEI tag reader 220 or a missing AEI tag 120 on the vehicle 102, and the onboard train control system 110 operates as though the "missing" vehicle were present. Preferably, the information authority 210 issues a maintenance report for the "missing" car so that maintenance personnel can inspect the car and replace any defective or missing AEI tag. Alternatively, the operator of the train/consist 101 or other yard personnel are instructed to perform a visual inspection of the train/consist 101 in order to determine the presence or absence of the "missing" vehicle, and the information in use by the onboard train control system 110 is updated accordingly.

It is also possible that the AEI tag reader 220 will fail to read one or more AEI tags that are in the expected consist information and also report the presence of one or more vehicles without AEI tags. In some embodiments, if the number of "missing" vehicles equals the number of vehicles without AEI tags reported by the AEI tag reader 220, it is assumed that the vehicles without the AEI tags correspond to those vehicles in the expected consist information that were not detected by the AEI tag reader 220. In other embodiments, such an assumption is not made and default, worst case length and weight values are assumed for any vehicles not detected by the AEI tag reader 220. In yet other embodiments, especially those used with consists that transport hazardous materials, the AEI tags must match the expected consist in order for the consist to be allowed to proceed. It is also possible to accept and use the information retrieved using the identifiers reported by the AEI tag reader 220 without regard to the expected consist information.

In the embodiments discussed above in connection with FIG. 1, AEI tag identifiers read by the AEI tag reader 220 are transmitted to the information authority 210, corresponding length and weight information is retrieved from the database 212, and any comparison between the information retrieved on the basis of the AEI tag identifiers is performed by the information authority 210. An alternative arrangement is illustrated in FIG. 2. In the system 200 of FIG. 2, the AEI tag reader 220 transmits the AEI tag identifiers it senses directly to the onboard train control system 110. The onboard train control system 110 also receives, from the information authority 210, database information comprising the AEI tag identifiers, length and weight of vehicles expected to be present in the train/consist 101. The onboard train control system 110 uses the information from the AEI tag reader 220 to confirm the accuracy of the expected consist data from the information authority 210 using processing similar to that performed by the information authority 210 discussed above in connection with FIG. 1.

In the embodiments discussed above, the AEI tag reader 220 reads the tags, and the vehicle position, length and weight information in use by the onboard train control system 110 is confirmed and/or updated, prior to the train/consist 101 moving or leaving the train yard. It will be recognized by those of skill in the art that accomplishing these objectives may require the furnishing of additional AEI tag readers 220 beyond those AEI tag readers that are already installed for freight tracking purposes. In other embodiments in which the provision of such additional AEI tag readers has not been accomplished, it is also possible to perform the AEI tag reading and onboard train control system 110 updating steps after the train/consist 101 has left the yard and passed an existing AEI tag reader 220.

Figure 3:
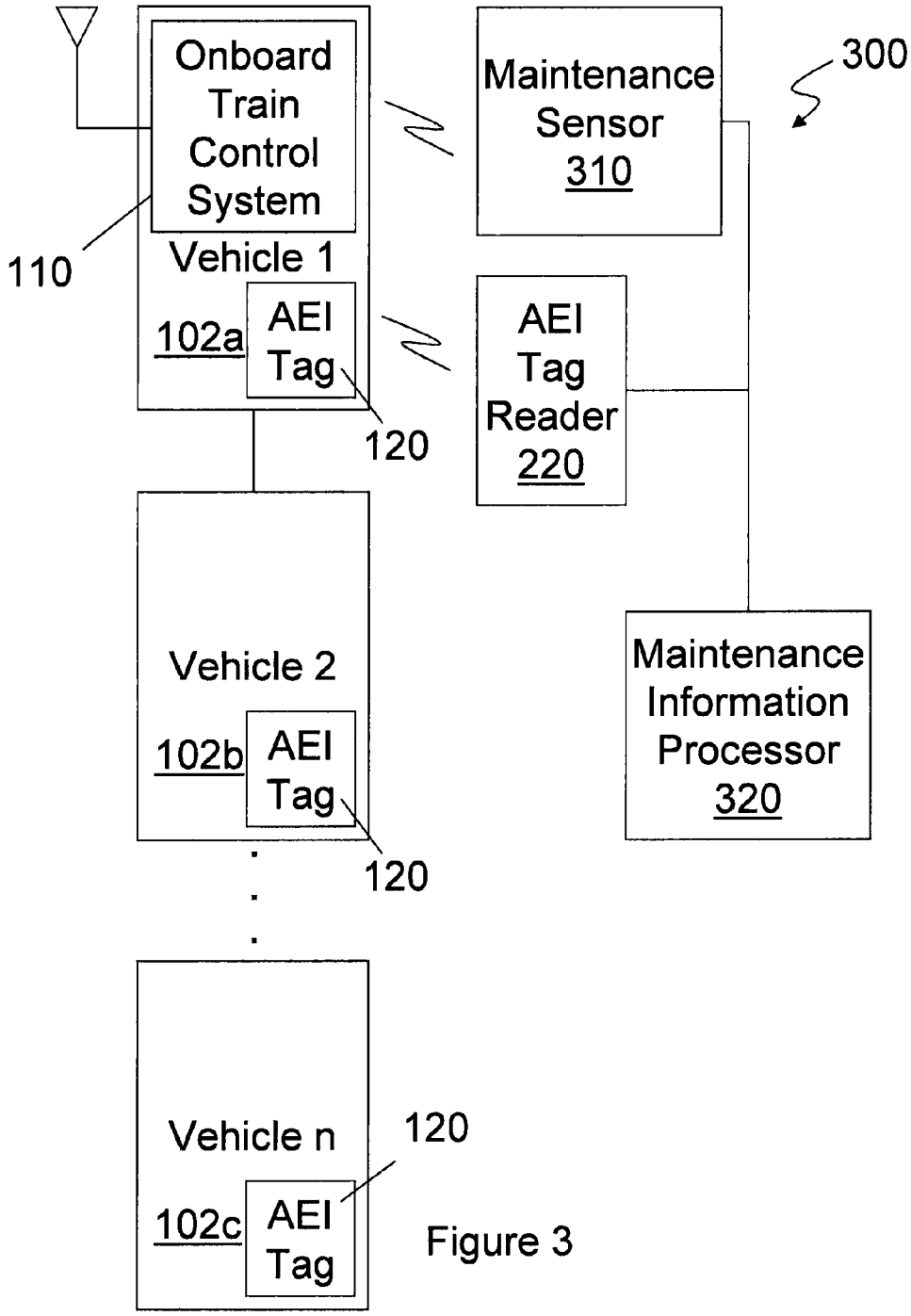
FIG. 3 is a block diagram of a maintenance information system according to another embodiment of the invention.

In addition to using AEI tag information for train control purposes, it is also possible to use AEI tag information for maintenance purposes. In particular, AEI tag information can be combined with information from a sensor that detects a condition requiring maintenance. A block diagram of such a system 300 is illustrated in FIG. 3. The system 300 includes an AEI tag reader 220 and a maintenance sensor 310. The maintenance sensor 310 may be any sensor that is capable of detecting a condition that indicates that one of the vehicles 102*a-n* of the train/consist 101 is in need of repair or maintenance. Examples of such maintenance sensors include hot bearing detectors (which sense excessive heat indicative of a failed, failing or overloaded bearing) and WILD (wheel impact load detector) sensors, which sense impact on rails caused by flat spots on train wheels. The maintenance sensor 310 may be positioned adjacent to a track but not be connected to the track as in the case of a hot bearing detector, or may be connected to the track as in the case of a WILD sensor. The AEI tag reader 220 and maintenance sensor 310 are placed in close physical proximity and arranged such that maintenance conditions detected by the maintenance sensor 310 and AEI tag information detected by the AEI tag reader 220 correspond to the same vehicle 102. When a vehicle 102 passes the AEI tag reader 220 and the maintenance sensor 310, the AEI tag 120 identifier and the maintenance sensor 310 information is sent to the maintenance information processor 320. If the information from the maintenance sensor 310 indicates a condition (e.g., a hot bearing) requiring maintenance on the vehicle 102, the maintenance processor transmits a message including the AEI tag identification information and the nature of the maintenance issue to appropriate maintenance personnel so that the requirement maintenance may be performed.

In some embodiments, the portable AEI tag reader discussed above includes an integrated GPS (global positioning system) receiver, preferably a DGPS (differential global positioning system) receiver. The GPS position of the portable AEI tag reader is transmitted along with each AEI tag number. Incorporating the GPS position provides further confirmation (along with the order in which the AEI tags are read) that the order of the cars is correct, and may be used to detect/infer the absence of an AEI tag on the car (i.e., if the GPS positions associated with two consecutively read AEI tags differ by more than two car lengths, it may be inferred that there is a car without an AEI tag located between the cars associated with the two AEI tags). Such portable AEI tag reader may be configured to communicate not only with trains or dispatchers, but also with cargo and car tracking systems, and the data from such portable AEI tag readers may be used for cargo or car tracking purposes other than for train control system purposes. Such data may also be forwarded to the railroad's customers for cargo tracking purposes.

The embodiments described above all involve AEI tags and AEI tag readers. However, it should be understood that any kind of identification tag and any kind of identification tag reader may be used in various embodiments, and all such tags and readers are within the scope of invention.

The foregoing examples are provided merely for the purpose of explanation and are in no way to be construed as limiting. While reference to various embodiments is made, the words used herein are words of description and illustration, rather than words of limitation. Further, although reference to particular means, materials, and embodiments are shown, there is no limitation to the particulars disclosed herein. Rather, the embodiments extend to all functionally equivalent structures, methods, and uses, such as are within the scope of the appended claims.

The purpose of the Abstract is to enable the patent office and the public generally, and especially the scientists, engineers and practitioners in the art who are not familiar with patent or legal terms or phraseology, to determine quickly from a cursory inspection the nature and essence of the technical disclosure of the application. The Abstract is not intended to be limiting as to the scope of the present inventions in any way.

What is claimed is:

1. A method for controlling a train consist comprising:

receiving a plurality of identification tag identifiers from an identification tag reader;

determining a weight and length of a vehicle associated with each of the identification tag identifiers;

determining, using the received identification tag identifiers, if there are one or more additional vehicles not in an expected composition of the train consist, and adding the weight and length of the one or more additional vehicles to an expected total weight and expected total length of the train consist; and controlling the train using the expected total weight and expected total length of the train consist.

2. The method of claim 1, wherein the train is controlled using an onboard train control system.

3. The method of claim 2, wherein the controlling step further comprises using the weights and lengths of vehicles determined using the identification tag identifiers to confirm train consist weight and length information previously stored in an onboard train control system.

4. The method of claim 1, further comprising the step of calculating the expected total weight and the expected total length of the train consist based on the weight and length of the vehicles associated with the identification tag identifiers received from the identification tag reader.

5. The method of claim 4, wherein the calculating step is performed by an onboard train control system.

6. The method of claim 1, wherein the receiving and determining steps are performed by an information authority processor located off of the train and in communication with the identification tag reader.

7. The method of claim 1, wherein the step of controlling the train includes calculating a braking curve based on the expected total weight of the consist.

8. The method of claim 1, wherein the identification tag reader is a stationary device.

9. The method of claim 1, wherein the identification tag reader is a handheld device.

10. The method of claim 9, wherein the handheld device further comprises a global positioning system receiver and the handheld device associates a location from the global positioning system reader with each identification tag read by the handheld device.

11. The method of claim 1, wherein the expected composition of the train consist is received from a device located on the train, and further comprising the step of transmitting a message to the train in the event of a mismatch between the identification tag identifiers received from the identification tag reader and the expected composition.

12. The method of claim 1, wherein the identification tag is a radio frequency identification tag.

13. The method of claim 1, wherein the identification tag is an automatic equipment identification (AEI) tag.

14. A method for dispatching a train comprising the steps of:

receiving a plurality of identification tag identifiers from an identification tag reader, each of the identification tag identifiers being associated with a respective vehicle of a train consist;

performing a comparison of the identification tag identifiers with an expected composition of the train consist;

determining, based on the comparison, if there are one or more additional vehicles not in the expected composition of the train consist, and adding at least one characteristic of the one or more additional vehicles to an expected total characteristic of the train consist; and authorizing a train movement based at least in part on the expected total characteristic of the train consist.

15. The method of claim 14, wherein the identification tag is an AEI tag.

16. The method of claim 14, wherein the train movement is a movement on a main line.

17. The method of claim 14, wherein the train movement is a movement in the train yard.

18. The method of claim 14, wherein the expected composition of the train consist is received from a device located on the train, and further comprising the step of transmitting a message to the train in the event of a mismatch between the identification tag identifiers received from the identification tag reader and the expected composition.

19. The method of claim 18, wherein the message includes train consist information based on the identification tag identifiers received from the identification tag reader.

20. The method of claim 11, wherein default length and weight values are added to the expected total length and expected total weight of the train consist when it is determined that an identification tag identifier has not been received for a vehicle in the expected composition of the train consist.

* * * * *